US005086293A

United States Patent [19]

Takahashi et al.

[11] Patent Number: 5,086,293

[45] Date of Patent: Feb. 4, 1992

[54] LINE INTERRUPTION SUPERVISORY DEVICE FOR A FIRE ALARM SYSTEM

[75] Inventors: Kaoru Takahashi; Akio Tsumuji; Ryuji Shutoku, all of Tokyo, Japan

[73] Assignee: Nohmi Bosai Kabushiki Kaisha, Tokyo, Japan

[21] Appl. No.: 542,050

[22] Filed: Jun. 22, 1990

[30] Foreign Application Priority Data

Jun. 29, 1989 [JP] Japan ..... 1-168164

[51] Int. Cl.[5] ..... G08B 29/00

[52] U.S. Cl. ..... 340/506; 340/509; 340/511; 340/514; 340/530

[58] Field of Search ..... 340/506, 505, 507-511, 340/514, 530, 825.06

[56] References Cited

U.S. PATENT DOCUMENTS 4,528,610 7/1985 Payne ..... 340/505
4,555,695 11/1985 Machida et al. ..... 340/514
4,847,593 7/1989 Igarashi ..... 340/505

*Primary Examiner*—Donnie L. Crosland
*Attorney, Agent, or Firm*—Wenderoth, Lind & Ponack

[57] ABSTRACT

A line interruption supervisory device for a fire alarm system is capable of reliably carrying out the line supervision even if the line length is long and/or there is a large number of connected fire detectors. To this end, a terminating capacitor is connected across the terminal of a pair of power/signal lines to which fire detectors are connected. A memory first stores the voltage available on the power/signal lines when the line supervision is requested, immediately followed by the interruption by a cut-off circuit of the power supply to a pair of power/signal lines, and further followed by a comparison of the voltage available on the power/signal lines before the power supply interruption with a line voltage available after a lapse of a predetermined time from the power supply interruption by a line interruption discriminating circuit to determine, according to any difference between these voltages, whether there is an open power/signal line.

9 Claims, 4 Drawing Sheets

LINE INTERRUPTION SUPERVISORY DEVICE FOR A FIRE ALARM SYSTEM

BACKGROUND OF THE INVENTION

1. Field of the Invention

The present invention relates to a line interruption supervisory device for a fire alarm system.

2. Description of the Prior Art

Japanese Utility Model Publication No. 57-38777 describes an example in which line interruption supervision is carried out by the discharge of a terminating capacitor provided across a terminal of lines (electric lines) to which fire detectors are connected.

This example carries out the line interruption supervision by comparing the divided voltage of the power supply voltage with the discharge voltage of the terminating capacitor, thus preventing false operation of the line interruption detecting circuit due to fluctuation of the power supply voltage. If there is no line interruption, the discharge voltage is higher than the divided voltage, and therefore the line interruption indicator does not light up. On the contrary, if there is an open line, the discharge voltage falls below the divided voltage, causing the line interruption indicator to light up. Furthermore, this example is capable of carrying out normal line interruption supervision even if the power supply voltage fluctuates because the divided voltage of the power supply voltage also fluctuates accordingly.

Voltage on lines having fire detectors connected thereto varies with the length of the lines and with the kind and number of fire detectors connected. In the above example, the longer the line length extends and/or the greater the number of fire detectors connected, the lower the discharge voltage becomes. Therefore, the discharge voltage could fall below the divided voltage, causing the line interruption indicator to light up even if there is no line interruption.

The present invention aims at offering a line interruption supervisory device for a fire alarm system which is capable of connected reliably carrying out the line supervision even if the line length is long and/or there is a large number of fire detectors.

SUMMARY OF THE INVENTION

The line interruption supervisory device for a fire alarm system according to the present invention causes the terminating capacitor to discharge when the power supply to a pair of power/signal lines is interrupted and compares the voltage available on the power/signal lines before the power supply interruption with a line voltage available after a lapse of a predetermined time from the power supply interruption to determine according to any difference between these voltages whether there is an open power/signal line.

Since the line interruption supervisory device for a fire alarm system according to the present invention determines according to any difference between the voltages available before and after interruption of the power supply, whether there is an open power/signal line, it is possible to carry out the line interruption supervision without fail even if the line length is long and/or there is a large number of fire detectors connected.

BRIEF DESCRIPTION OF THE DRAWINGS

The invention will now be described with reference to the accompanying drawings wherein.

DESCRIPTION OF THE PREFERRED EMBODIMENTS

Figure 1:
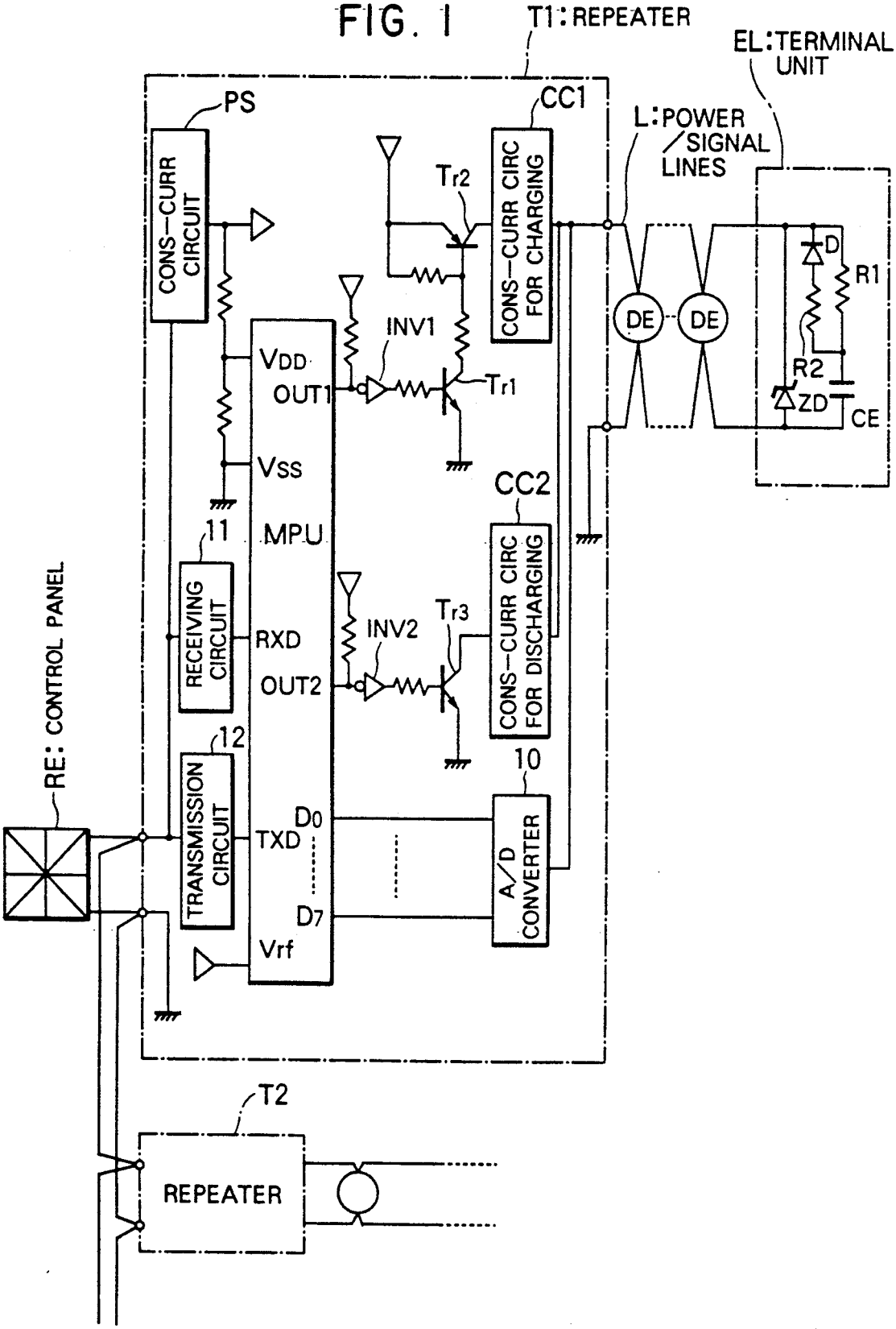
FIG. 1 is a circuit diagram of a line interruption supervisory device for a fire alarm system according to an embodiment of the present invention.

Referring now to the drawings, one embodiment of the line supervisory device is shown in FIG. 1 in which repeaters T1, T2, fire detectors DE and a terminal unit EL are provided. The repeater T2 is identical to repeater T1, and additional repeaters identical to the repeater T1 are also provided. These repeaters T1, T2 . . . are connected to the control panel RE.

The repeater T1 is equipped with a power supply PS, a receiving circuit 11, a transmission circuit 12, a microcomputer MPU, inverters INV1, INV2, transistors Tr1, Tr2, Tr3, a constant-current charging circuit CC1, a constant-current discharging circuit for discharging CC2 and an A/D converter 10. Fire detectors are connected with the repeater T1 through power/signal lines L.

The terminal unit EL is equipped with a terminating capacitor CE, a rush current prevention resistor R1, a zener diode ZD, a diode D and a resistor R2.

Figure 2:
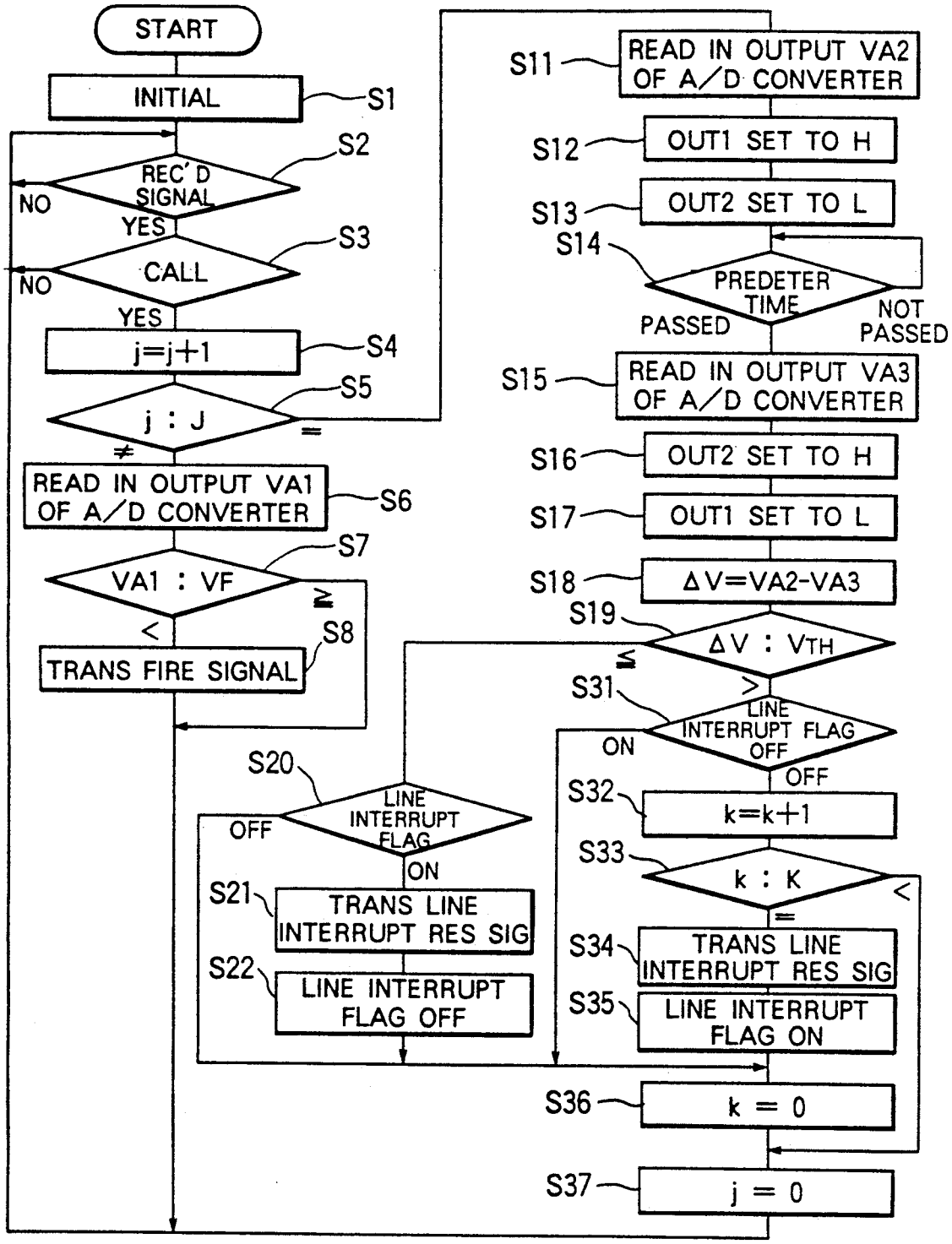
FIG. 2 is a flowchart showing the operation of the repeater T1 in the embodiment of FIG. 1.

The microcomputer MPU executes a program according to the flowchart shown in FIG. 2 and is equipped with data input ports D0~D7, output ports for controls OUT1, OUT2, a built-in comparator and a reference voltage input port Vrf of the comparator.

The constant-current charging circuit CC1 is a circuit which supplies a predetermined constant current to the fire detectors DE and the terminal unit EL through the power/signal lines L. The constant current discharging CC2 constituting a part of the discharge loop of the terminating capacitor CE is a circuit which keeps the inclination of the characteristic showing changes in the discharge current constant to avoid rapid drops in the discharge voltage (voltage on the power/signal lines L).

The A/D conventor 10 is a circuit which converts the analog voltage on the power/signal lines L to a digital value.

The transistors Tr1, Tr2 switch off when the power supply to the power/signal lines L is interrupted. Combination of the microcomputer MPU with the transistors Tr1, Tr2 is an example of a means to cut off the power supply to the power/signal lines.

The transistor Tr3 causes the terminating capacitor CE to discharge. Combination of the microcomputer MPU with the transistor Tr3 is an example of a discharge means which causes the terminating capacitor to discharge when the power supply to the power/signal lines is interrupted.

The power supply PS comprises a constant-voltage circuit which converts the power supplied from the control panel RE through the power/signal lines L to voltage required for the internal circuits and the fire detectors.

The microcomputer MPU contains a memory which is an example of a memory means for storing the voltage available on the power/signal lines immediately before the power supply is interrupted. Furthermore, the microcomputer MPU is also an example of a line interruption discriminating means to determine according to any difference between the voltages available after a lapse of the predetermined time from power supply interruption and immediately before the power supply interruption whether there is an open power/signal line.

Next, the operation of the above embodiment will be described hereinafter.

FIG. 2 is a flowchart showing the operation of the repeater T1 in the above embodiment.

First, the variables j and k representing the number of calls from the control panel RE and the number of line interruptions detected, respectively, are both initialized to zero. The outputs OUT1 and OUT2 of the microcomputer MPU are also initialized to L and H, respectively (S1). With the output OUT1 of the microcomputer MPU set to L the tramsistors Tr1, Tr2 switch on, and with the output OUT2 set to H the transistor Tr3 switches off.

If a signal is received from the control panel RE and it is a call signal (S2, S3), the number of calls j from the control panel RE is incremented by one (S4). If the number of calls j does not reach a predetermined number J (e.g. 10 calls) (S5), the output VA1 of the A/D converter is read in (S6) and compared with the fire signal discriminating voltage VF (S7). If the fire detector DE is in an operating state at this time, the output VA1 of the A/D converter falls below the fire signal discriminating voltage VF, then the repeater transmits a fire signal together with, for example, its self-address to the control panel RE from the transmission circuit 12 (S8), and the program returns to step S2. If the output VA1 of the A/D converter is above the fire discriminating voltage VF, it does not mean a 'fire', and the program returns to the step S2. Provision may be made so that a response signal will be transmitted to the control panel RE when there is no fire.

On the other hand, when the number of calls j to the repeater T1 from the control panel RE has reached the predetermined number J, the output voltage VA2 of the A/D converter 10 (voltage available immediately before power supply interruption) is read in (S11), and then the output OUT1 is set to H (S12). As the output OUT1 is set to H, the transistors Tr1, Tr2 switch off and the constant-current charging circuit CC1 goes into the OFF state. Consequently, power supply to the power/signal lines L is interrupted.

Next, the output OUT2 is set to L (S13), and this causes the transistor Tr3 to switch on and the constant-current discharging circuit CC2 to go into the ON state, thereby establishing the discharge circuit. The charge on the terminating capacitor CE is now gradually released through the power/signal lines L, the constant-current discharging circuit CC2 and the transistor Tr3. After a predetermined time (e.g. 1 ms), the output voltage VA3 (voltage available after power supply interruption) of the A/D converter 10 is read in (S15), and this read-in voltage VA3 is written in the memory in the microcomputer MPU.

Then, the discharge circuit is set to an OFF state, and the charge circuit is set to an ON state. In other words, the output OUT2 is set to H (S16) to set the constant-current discharging CC2 to the OFF state, and the output OUT1 is set to L (S17) to actuate the constant-current charging circuit for charging CC1. A calculation of a voltage difference $\Delta V$ ($=VA2-VA3$) is then made by subtracting the voltage available after power supply interruption VA3 from the one available immediately before power supply interruption VA2 (S18).

If the voltage difference $\Delta V$ is less than a threshold voltage $V_{TH}$ (e.g. 6 V) as a reference for line interruption judgement (S19), it is determined that there is no line interruption. The state of the line interruption flag is also checked at this time (S20). If the line interruption flag is set (ON), the line interruption restoration signal is transmitted (S21) to clear (OFF) the line interruption flag (S22).

On the contrary, if the voltage difference $\Delta V$ is greater than the threshold voltage $V_{TH}$ (S19), the state of the interruption flag is checked (S31). If the line interruption flag is OFF, the number of detected line interruptions k is incremented by one (S32). When the number of detected line interruptions has reached a predetermined number of detections K (e.g. 5) (S33), the line interruption signal is transmitted to the control panel RE (S34) to set (ON) the line interruption flag (S35) and to initialize both the number of detected line interruptions k and the number of calls j from the control panel RE to zero (S36), (S37). Then, the program returns to step S2.

The line interruption flag is set (ON) when the line interruption signal is transmitted to the control panel RE, and is cleared (OFF) when the line interrupted state has been restored to the normal state. Since the above embodiment determines a line interruption by looking at whether the difference ($\Delta V$) between the line voltages available immediately before the start of discharge and after a lapse of the predetermined time from the start of discharge has reached a predetermined voltage, it is capable of reliably discriminating a line interruption even if the line length, the number and kind of connected detectors are changed.

Figure 3:
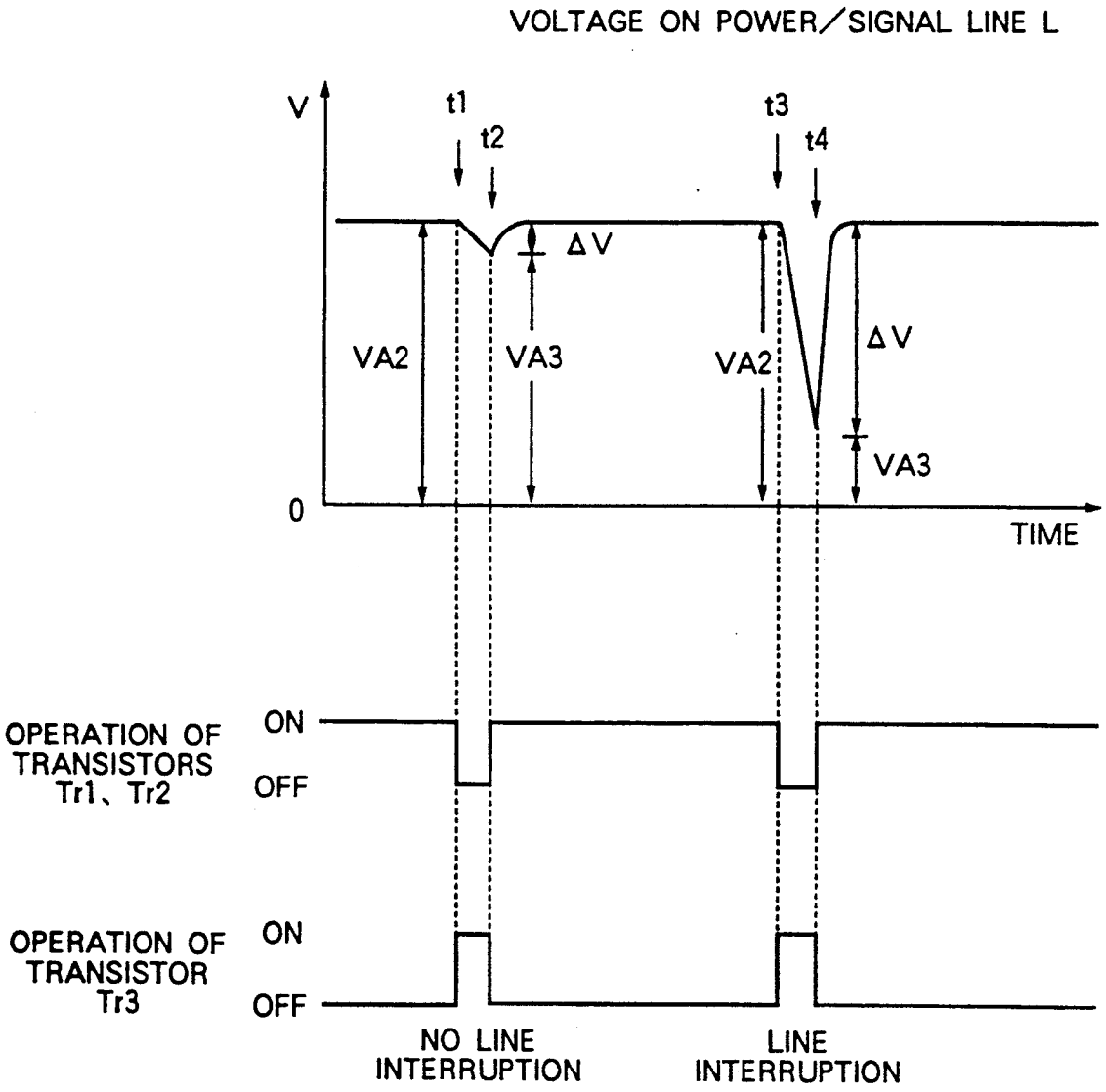
FIG. 3 is a drawing illustrative of the operation in the embodiment of FIGS. 1 and 2.

FIG. 3 is a drawing illustrative of the above embodiment.

In FIG. 3 a non-interrupted state is shown on the left hand side and a line interrupted state is shown on the right hand side.

Although the voltage VA2 available at the time t1 immediately before power supply interruption in the case where there is no open line is equal to the voltage VA2 available at the time t3 immediately before power supply interruption where there is an open line, the voltage VA3 available at the time t2 after power supply interruption in the former case is higher than the voltage VA3 available at the time t4 after power supply interruption in the latter case. Accordingly, the voltage difference $\Delta V$ in the case with no open line is smaller than the voltage difference $\Delta V$ in the case with an open line. Based on this difference a judgement is made as to whether there is an open power/signal line. The voltage difference $\Delta V$ is influenced very little by line length or the number of by fire detectors connected.

Further, it is easier to discriminate between a line interruption and no line interruption if the discharge current of the terminating capacitor CE is restricted by providing the constant-current discharging circuit CC2 because this lessens the voltage drop due to the line resistance at the time of discharge and consequently the voltage drop at the time of discharge in normal conditions regardless of the line length.

The above description relates to the operation of the repeater T1 but is also applicable to the other repeaters T2 and so on.

Figure 4:
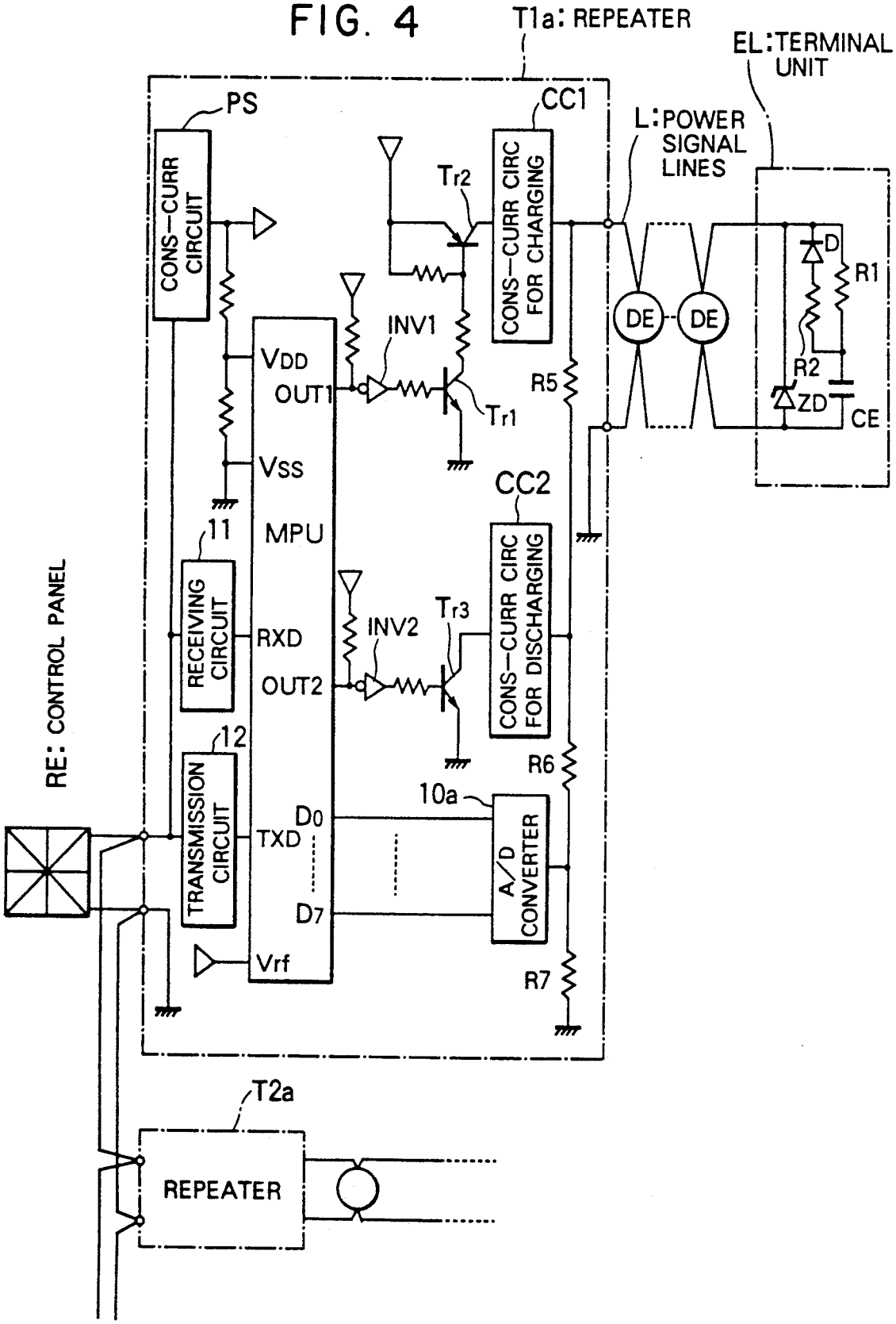
FIG. 4 is a circuit diagram showing another embodiment of the line interruption supervisory device according to the present invention.

FIG. 4 is a circuit diagram showing another embodiment according to the present invention.

The repeater T1*a* shown in FIG. 4 is basically identical to the repeater T1 shown in FIG. 1 but differs in the way voltage is input to the A/D converter 10*a* in comparison to that for the A/D converter 10. More precisely, the A/D converter 10 of FIG. 1 has a direct input from the power/signal lines L, while in the A/D converter 10*a* of FIG. 4 the voltage on the power/signal lines L is divided by resistors R5, R6 and R7 and then fed to the A/D converter 10*a*. While the A/D converter 10 in the embodiment shown in FIG. 1 is used where the maximum value of the voltage on the power/signal lines L can be input as is, the A/D converter 10*a* shown in FIG. 4 can not have the voltage on the power/signal lines L input as is and uses a lowered voltage because of its small withstand voltage.

The A/D converters 10, 10*a* of the repeater T1 may be built in the microcomputer MPU.

In the above embodiments, the constant-current charging circuit CC1 and the constant-current discharging circuit CC2 may be omitted, with the microcomputer built in the A/D converter instead.

While each of the above embodiments shows the line supervision by repeater, the above also applies to cases where the line supervision is carried out by a control panel. In this case, however, the steps S2, S3 in FIG. 2 are omitted and the number of calls j is replaced, for example, by count of the timer output.

While the embodiments of the present invention, as herein disclosed, constitute a preferred form, it is to be understood that other forms might be adapted.

What we claim is:

1. A line interruption supervisory device for a fire alarm system, comprising:

a terminating capacitor connected across a terminal of a pair of power/signal lines to which fire detectors are connected;

a cut-off means for cutting off a power supply to the power/signal lines;

a discharge means for causing the terminating capacitor to discharge upon interruption of the power supply to the power/signal lines;

a memory means for storing a first voltage available on the power/signal lines immediately before interruption of the power supply; and a line interruption discriminating means for determining, according to any difference between a second voltage available on the power/signal lines after a lapse of a predetermined time from the interruption of the power supply and the first voltage stored in said memory means, whether there is an open power/signal line.

2. A line interruption supervisory device for a fire alarm system as set forth in claim (1) wherein the cut-off means, discharge means, memory means and line interruption discriminating means are provided in a control panel.

3. A line interruption supervisory device for a fire alarm system as set forth in claim (1) wherein the cut-off means, discharge means, memory means and line interruption discriminating means are provided in a repeater.

4. A line interruption supervisory device for a fire alarm system as set forth in claim (1), (2), or (3) wherein the terminating capacitor is charged through a constant current circuit.

5. A line interruption supervisory device for a fire alarm system as set forth in claim (1), (2), or (3) wherein the discharge means causes the terminating capacitor to discharge through a constant current circuit.

6. A line interruption supervisory device for a fire alarm system as set forth in claim (1), (2), or (3) wherein the terminating capacitor is charged through a constant current circuit, and the discharge means causes the terminal capacitor to discharge through the constant current circuit.

7. A line interruption supervisory device for a fire alarm system as set forth in claim (1), (2), or (3) wherein the line interruption discriminating means determine that there is an open power/signal line when the line interrupted state has been detected a plurality of times.

8. A line interruption supervisory device for a fire alarm system as set forth in claim (1), (2), or (3) wherein the line interruption discriminating means is equipped with a restoration discriminating means to determine whether the line interruption state has been restored to a normal state, and initiates a line interruption restoration signal upon restoration from the line interruption.

9. A line interruption supervisory device for a fire alarm system as set forth in claim (7) wherein the line interruption discriminating means is equipped with a restoration discriminating means to determine whether the line interruption state has been restored to a normal state, and initiates a line interruption restoration signal upon restoration from the line interruption.

* * * * *